US005836446A

United States Patent [19]

Varnom

[11] Patent Number: 5,836,446

[45] Date of Patent: Nov. 17, 1998

[54] TOOL CADDY

[75] Inventor: Laurence T. Varnom, Jacksonville, Fla.

[73] Assignee: Bowvar Industries, Inc., Ocala, Fla.

[21] Appl. No.: 643,374

[22] Filed: May 6, 1996

[51] Int. Cl.[6] ..... B65D 85/00

[52] U.S. Cl. ..... 206/373; 211/70.6

[58] Field of Search ..... 206/362, 372–379; 211/60.1, 65, 68, 69, 70, 70.6; 220/23.83, 23.86, 527, 528

[56] References Cited

U.S. PATENT DOCUMENTS

| | | | |
|---|---|---|---|
| 160,339 | 3/1875 | Ladd | 211/70 |
| 421,352 | 2/1890 | Weese et al. | 211/70 |
| 492,304 | 2/1893 | Markle | 211/70 |
| 1,148,895 | 8/1915 | Gehl | 211/60.1 |
| 4,534,471 | 8/1985 | Zahn et al. | 211/163 |
| 4,826,007 | 5/1989 | Skeie | 206/373 |
| 5,074,421 | 12/1991 | Coulter | 211/163 |
| 5,379,885 | 1/1995 | Chen | 206/373 |
| 5,392,901 | 2/1995 | Kuray et al. | 206/372 |

FOREIGN PATENT DOCUMENTS

| | | | |
|---|---|---|---|
| 811553 | 4/1969 | Canada | 211/163 |

*Primary Examiner*—Jimmy G. Foster
*Attorney, Agent, or Firm*—Arthur G. Yeager

[57] ABSTRACT

A tool carrying insert for a bucket, the insert having an upper plate rigidly joined by a centrally located vertical connector to a dish spaced below the plate; the plate being of a size to overhang the rim of a bucket, being pierced by a plurality of passageways to receive and hold tools positioned vertically, and having a centrally located handle projecting upwardly therefrom; the dish being a flat open shallow container with upwardly disposed outer edges and having a plurality of spaced partitions with the bottom of the dish spaced upwardly from the bottom of the bucket.

20 Claims, 3 Drawing Sheets

TOOL CADDY

BACKGROUND OF THE INVENTION

Hand tools such as screwdrivers, pliers, hammers, wrenches, stapler, drill bits, etc., are used everywhere, and are always somewhat of a nuisance to carry. Some tradesmen use small tool boxes for this purpose; others use a belt from which several tools are suspended. Regardless of the type of carrier it never seems to be sufficient for all purposes. The present invention solves some of these problems by providing more than normal space, and by being useful with an ordinary bucket, which may also be needed at the workplace.

It is an object of this invention to provide a tool carrier that can be used with a bucket. It is another object of this invention to provide a novel tool caddy that can be carried separately from a bucket, and is lightweight and inexpensive. Still other objects will become apparent from the more detailed description which follows.

BRIEF SUMMARY OF THE INVENTION

This invention relates to a tool holding device adapted to be inserted into and carried by a bucket; said tool holding device includes an upper horizontal plate spaced above and rigidly joined to a lower horizontal dish; a short vertical wall around the outer perimeter of the plate, the plate being of a size to overlie and rest on the rim of the bucket. The plate is pierced by a plurality of passageways designed to receive and hold vertically hand tools with some part of the tools hanging below the plate and having a centrally located handle for lifting the tool holding device vertically. The lower horizontal dish is a shallow open container with an upturned edge; said plate and said dish being rigidly joined together by vertical connector means to dispose said dish below the plate and above the bottom of the bucket.

In specific and preferred embodiments of this invention the plate contains circular passageways with depending tubular guides for screwdrivers and slotted passageways for pliers; the connector is a tube which mates with bosses on the plate and the dish; or may be a pair of telescopic tubes respectively molded with the pate and dish. The tool holding device is positioned within the bucket sufficiently high to leave a space below the dish for other tools, and the dish is sectioned by partitions.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
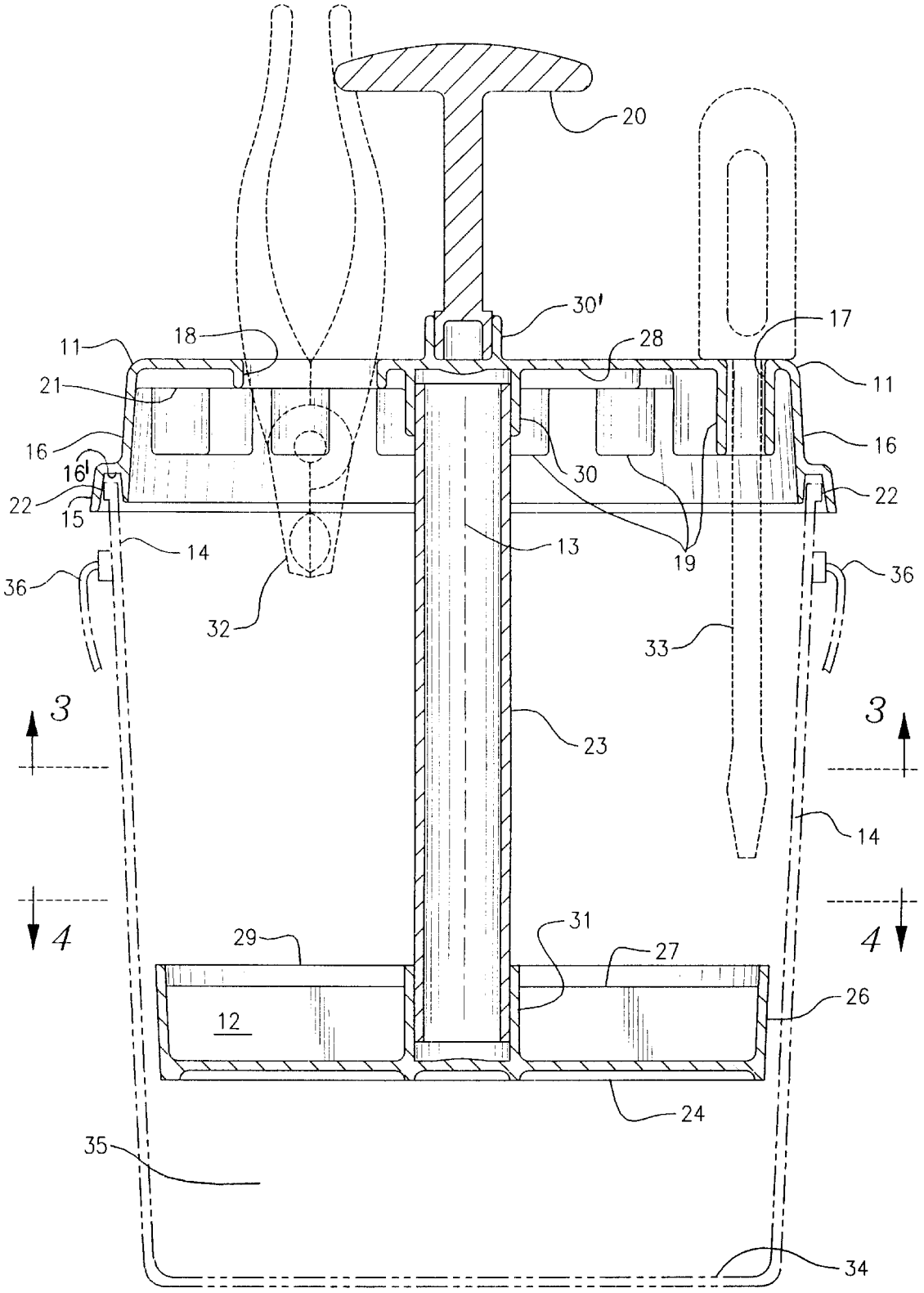
FIG. 1 is a sectional elevated view of the tool holding device according to the present invention shown mounted in a bucket and taken on line 1—1 of FIG. 2.

The novel features of this invention can best be understood by reference to the attached drawings.

The tool holding device includes an upper horizontal plate 11 spaced vertically above a lower horizontal dish 12, both of which are perpendicular to a common central vertical axis 13. Upper plate 11 and lower dish 12 are rigidly joined to each other by a vertical connector 23, which may be a rod or tube. In the embodiment shown here the vertical connector 23 is a tube which is seated at each end onto bosses 30 at plate 11 and 31 at dish 12. The actual connection between connector 23 and bosses 30 and 31 may be by screw threads, welding, or adhesive. Since all parts of the tool holding device are expected to be light in weight they should be made of aluminum or plastic and connector 23 joined to these parts by welding or strong adhesives.

Figure 2:
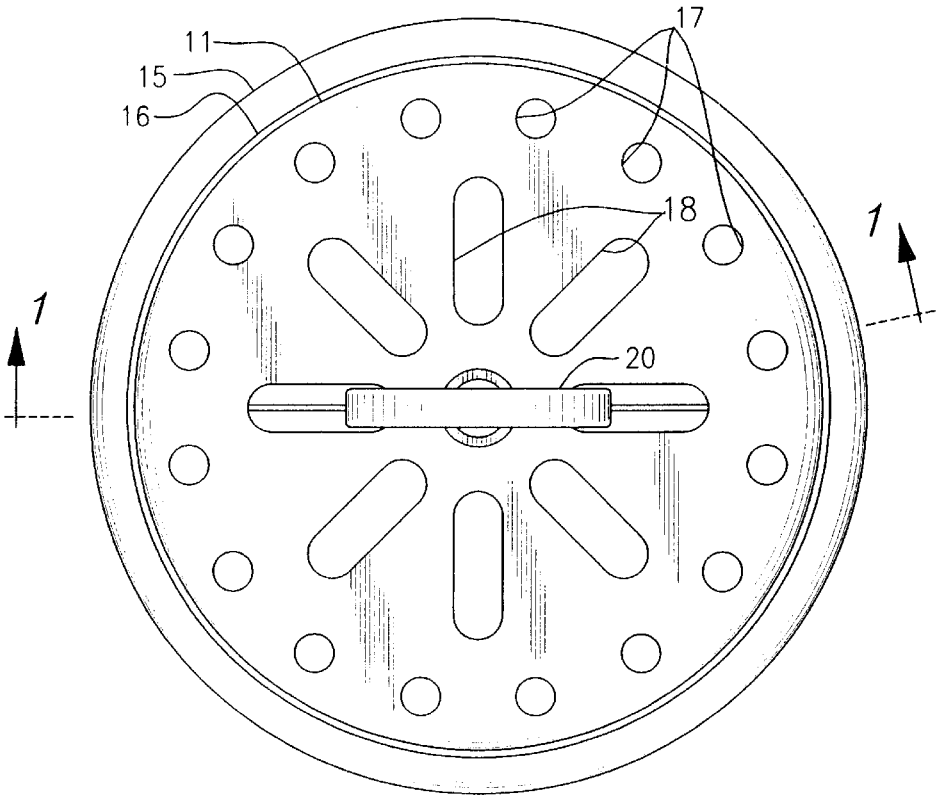
FIG. 2 is a top plan view of the upper plate as mounted on the device of FIG. 1.
Figure 3:
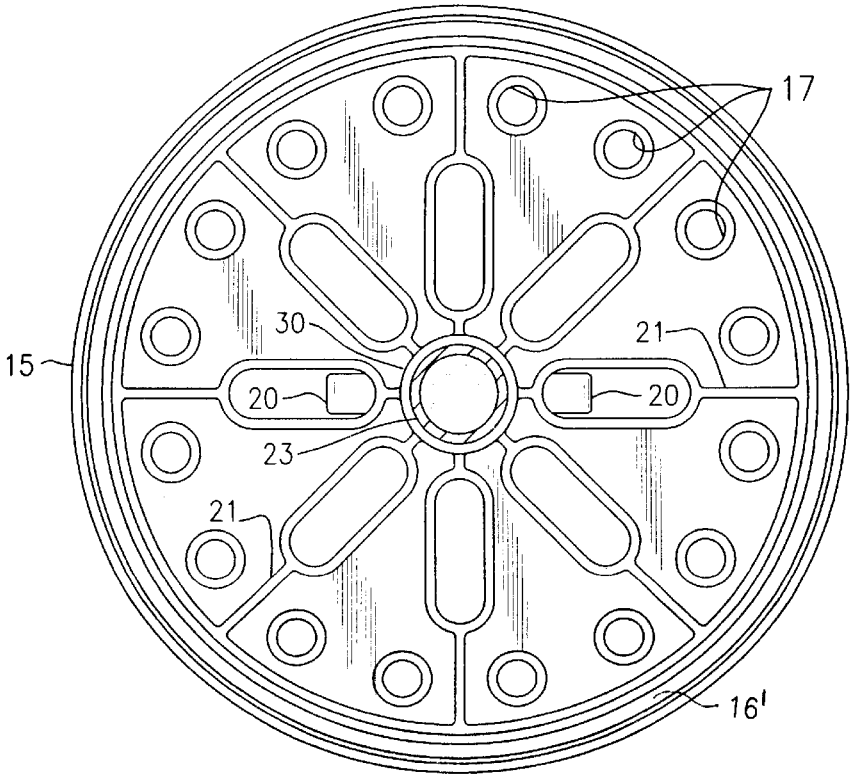
FIG. 3 is a bottom plan view of the upper plate of FIG. 2 taken from line 3—3 of FIG. 1

Upper plate 11 is preferably flat and circular to fit the open top of a circular bucket 14 having conventional ball handle 36. If bucket 14 has a rectangular open top, plate 11 may also be rectangular. The outer perimeter 15 of plate 11 is sufficiently large in diameter or dimension to overlie the rim 22 of bucket 14 and be held in place gently. A short upstanding perimeter wall 16 extends around perimeter 15 and terminates in a channel member 16'. Reinforcing radial ribs or webs 21 are preferably formed on the bottom surface 28 of plate 11 for added strength as shown in FIG. 3. Plate 11 is pierced with a plurality of passageways or holes of various sizes and shapes and to receive and hold tools inserted vertically in those passageways or holes, as shown in FIGS. 1–3. Typically there will be a number of circular holes 17 to receive screwdrivers 33 and a number of slotted holes 18 to receive pliers 32. Screwdriver holes 17 are augmented with short tubular guides 19 depending downwardly below plate 11 to restrict the lateral movement of the screwdriver handle and shank, which might otherwise become tangled with adjacent tools. Guides 19 preferably are short (1–3 inches) lengths of tubing welded or otherwise attached to plate 11. Still other passageways or holes through plate 11 may be added for other tools, e.g., hammer, wrench, square. A preferred arrangement of passageways and holes 17 and 18 is for an outer circle of screwdriver holes 17 spaced circumferentially inside wall 16 and the remaining, more central area of plate 11 to be used for other tools.

Figure 5:
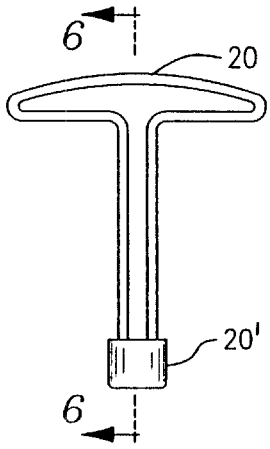
FIGS. 5 and 6 are alternative views of the handle of the device of FIG. 1.
Figure 6:
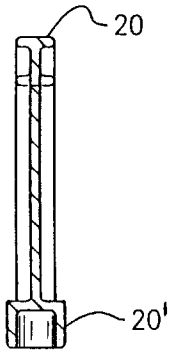

A central handle 20 is rigidly attached to the upper surface of plate 11 by threads, welding, or the like as shown in FIGS. 1, 5 and 6. The shape of handle 20 is optional; a generally T-shaped handle being shown in the drawings.

Figure 4:
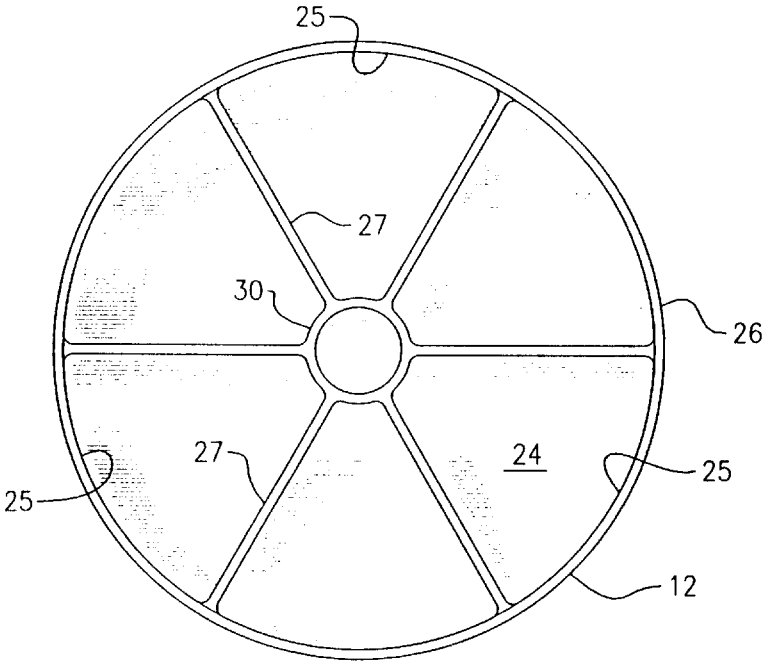
FIG. 4 is a top plan view of the lower dish of the device of FIG. 1 taken from the line 4—4 of FIG. 1.

Lower horizontal dish 12 is a shallow container of any chosen shape, i.e., circular, rectangular, polygonal, or the like. Dish 12 has an open top, a closed bottom 24 and an outer perimeter wall 26. The internal space may be left open and undivided or divided by radial compartment walls 27 into 4–8 compartments 25 that may be used to contain nails, screws, washers, rivets, staples, or the like as shown in FIG. 4. Dish 12 is positioned sufficiently below plate 11 so as not to interfere with tools hanging downward from plate 11, and yet close enough to plate 11 to leave as much space 35 as possible between bottom 24 of dish 12 and bottom 34 of bucket 14. Space 35 may be used to carry other tools that cannot be inserted into passageways in plate 11.

FIGS. 5 and 6 illustrate two views of the handle 20 and show lower flange 20' which may be welded or otherwise attached to an upper boss 30' (FIG. 1) for support of the entire tool holding device. As understood in the art, there are a wide variety of methods to mount handle 20 to upper plate 11.

Figure 7:
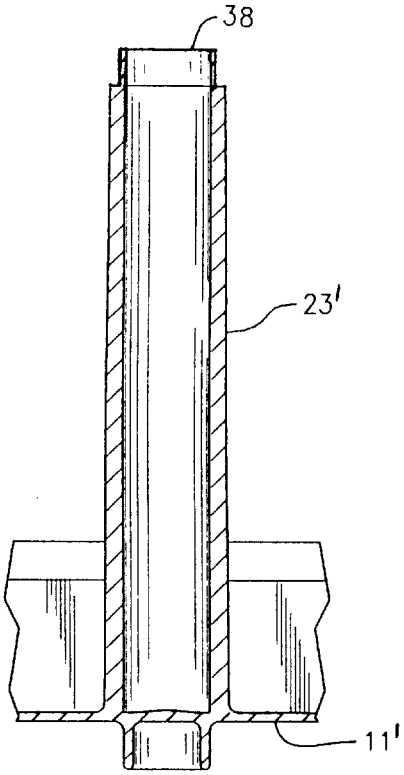
FIGS. 7 and 8 are an alternative construction of the vertical mounting post of the device of FIG. 1.
Figure 8:
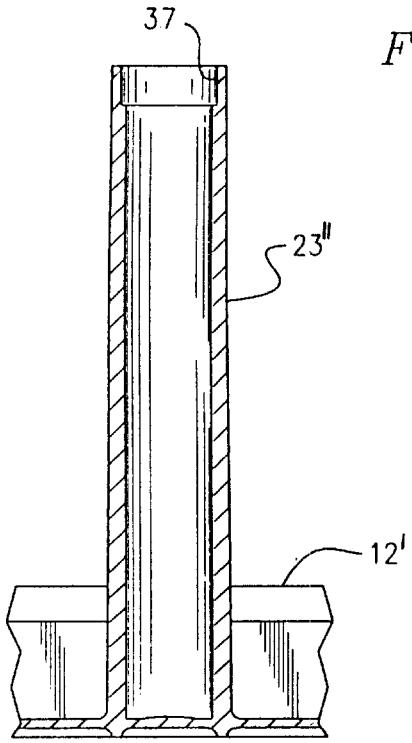

FIGS. 7 and 8 illustrate a telescopic, two-section alternative embodiment of the vertical post 23 that connects upper plate 11 and lower dish 12. Post member 23' is molded (or welded) to an upper plate 11' (FIG. 7) and post member 23" is molded (or welded) to lower dish 12'. Insert fitting 38 fits inside boss 37 and is attached thereto by glue or whatever means are appropriate in the circumstances. Plate 11' and dish 12' are otherwise identical to respective plate 11 and dish 12 shown and described in FIGS. 1–4.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A tool holding device adapted to be inserted into and carried by a bucket; comprising an upper horizontal flat plate spaced above and rigidly joined to a lower horizontal dish, a short generally vertical wall extending downwardly from and around the outer perimeter of said plate, said plate extending radially outwardly, said vertical wall adjacent its lower extremity having a shoulder formed therein to overlie and be supported on a rim of a bucket with an outer extremity of said vertical wall locatable outwardly of a rim of a bucket, said vertical wall being spaced outwardly of said dish said plate including a plurality of passageways for receiving and holding vertically therein hand tools with a lower part of tools hanging below said plate and handles of tools above said plate, a centrally located handle connected to said plate and extending upwardly therefrom for lifting said tool holding device vertically into and out of a bucket, said lower horizontal dish including a shallow open container with an upturned outer edge and a substantially flat bottom supportable on a horizontal surface when removed from a bucket, said outer edge when said shoulder overlies a rim of a bucket being spaced from a bucket wall with said bottom of said container being spaced above a bottom of a bucket, said plate and said dish being rigidly joined together by a vertical spacer connector means to dispose said dish below lower parts of tools hanging below said plate.

2. The tool holding device of claim 1 wherein a plurality of said passageways are generally circular each of which includes a tubular guide extending below said plate and terminating above and remotely from said dish.

3. The tool holding device of claim 2 wherein said tubular guide extends sufficiently to inhibit lower parts of tools from extending laterally outwardly of said perimeter of said plate.

4. The tool holding device of claim 3 wherein said circular passageway and its accompanying tubular guides are designed to receive single shaft tool lower parts.

5. The tool holding device of claim 1 wherein a plurality of said passageways are slot-shaped to receive and hold dual shaft lower parts.

6. The tool holding device of claim 1 wherein said spacer connector means is a tube rigidly fastened at one end to said plate and at the other end to said dish.

7. The tool holding device of claim 6 wherein said spacer connector is positioned centrally about a vertical axis passing perpendicularly and centrally of said plate and said dish.

8. The tool holding device of claim 1 wherein said plate includes a plurality of reinforcing webs extending downwardly and radially along a lower face of said plate facing said dish.

9. The tool holding device of claim 2 wherein said circular passageways are located spacedly in a circular pattern spaced inwardly from and adjacent said perimeter of said plate.

10. The tool holding device of claim 1 further comprising a plurality of spaced radial walls connected to said dish within said upturned edge dividing said dish into separate compartments.

11. A tool holder insertable into an open top bucket comprising a flat horizontal upper plate, a lower horizontal dish spaced remotely from said plate, said plate having a perimeter greater than an open top of a bucket, a short generally vertical wall attached to said perimeter of said plate and having an outer extremity adapted to be located outwardly of a rim of a bucket, said plate having a plurality of tool receiving passageways extending substantially vertically through said plate, a flange extending outwardly of said short wall and being in general alignment with said plate, said flange being adapted to rest on and be supported by an upper edge of a bucket, said passageways including a plurality of circular holes adjacent and inwardly of said perimeter of said plate to receive single part tools therein and a tubular guide attached to and depending downwardly from said hole and terminating remotely from said dish, and a plurality of elongated slot shaped holes to receive dual part tools therein, said dish including a shallow open top container having an upturned perimeter wall and a plurality of radial walls to divide said container into a plurality of generally wedge-shaped compartments, and an elongated spaced vertical connector respectively rigidly joined at one end to said plate and at its other end to said dish.

12. The tool holder of claim 11 further comprising a bucket having a bottom and a handle, said holder having an overall vertical length from said plate to said dish to provide a space between said dish and said bottom of said bucket to receive other hand tools unsupportable in said holes and said slots.

13. The tool holder of claim 11 wherein said plate includes a plurality of substantially equally spaced downward reinforcement webs along a lower face of said plate.

14. The tool holder of claim 11 further comprising a pair of spaced opposed bosses on respective said plate and said dish, said connector being an elongate tube rigidly respectively attached to said boss on each said plate and said dish.

15. The tool holder of claim 11 further comprising a T-shaped handle having a lower end attached centrally of said plate and an upper end extending generally parallel and spaced from said plate.

16. The tool holder of claim 11 wherein said plate and dish are circular.

17. The tool holder of claim 11 wherein said dish includes a flat bottom for supporting said holder on a horizontal surface when removed from a bucket.

18. The tool holder of claim 15 further comprising a bucket having a bottom and a bail handle, said bail handle being located when said bail handle is engaged by a hand of a user above said plate and substantially vertically above said T-shaped handle.

19. The tool holder of claim 18 wherein said holder has an overall vertical length from said plate to said dish to provide a space between said dish and a bottom of said bucket.

20. The tool holder of claim 19 wherein said bucket includes a generally circular upper edge, said upstanding wall and said plate and said dish are substantially circular, said dish generally conforming in size to an adjacent wall of said bucket when said plate rests and is supported on said upper edge of said bucket.

* * * * *